US008950209B2

(12) United States Patent
Junge et al.

(10) Patent No.: US 8,950,209 B2
(45) Date of Patent: Feb. 10, 2015

(54) BOTTOM MOUNT REFRIGERATOR AIRFLOW SYSTEM

(75) Inventors: Brent Alden Junge, Evansville, IN (US); Blake Mackenzie Whelan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 167 days.

(21) Appl. No.: 13/545,095

(22) Filed: Jul. 10, 2012

(65) Prior Publication Data

US 2014/0013794 A1 Jan. 16, 2014

(51) Int. Cl.
*F25D 11/02* (2006.01)
*F25D 17/06* (2006.01)

(52) U.S. Cl.
USPC ..... 62/419; 62/426; 62/441

(58) Field of Classification Search
CPC ..... F25D 17/045; F25D 17/065; F25D 17/06; F24F 5/0017
USPC ..... 62/419, 426, 441
See application file for complete search history.

(56) References Cited

U.S. PATENT DOCUMENTS 3,872,683 A 3/1975 Blanton
5,156,015 A 10/1992 Chung
5,282,367 A * 2/1994 Moore et al. ..... 62/256
7,926,298 B2 4/2011 Kuehl et al.
2010/0126201 A1* 5/2010 Seo et al. ..... 62/340
2010/0218468 A1 9/2010 Curtis et al.
2011/0011106 A1* 1/2011 Ahn et al. ..... 62/89

FOREIGN PATENT DOCUMENTS

WO 2010099464 A2 9/2010

OTHER PUBLICATIONS

U.S. Appl. No. 13/545,103, filed Jul. 10, 2012, Brent Alden Junge, et al.

* cited by examiner

*Primary Examiner* — Steve M Gravin
*Assistant Examiner* — Filip Zec
(74) *Attorney, Agent, or Firm* — Global Patent Operation; Douglas D. Zhang

(57) ABSTRACT

A refrigeration system includes an airflow system which eliminates the traditional evaporator fan cover assembly in the freezer area by utilizing at least one air outlet formed between a freezer cavity area and a duct coupled to the fresh food cavity area. The air outlet is configured to permit at least a portion of a cooled air stream generated by a fan of the evaporator assembly received in the freezer cavity area to be provided to the fresh food cavity area through the air outlet and via the duct. The refrigeration system also includes at least one air return formed between the evaporator assembly and the fresh food cavity area. The air return is configured such that air from the fresh food cavity area flows into the evaporator assembly through the air return.

16 Claims, 7 Drawing Sheets

BOTTOM MOUNT REFRIGERATOR AIRFLOW SYSTEM

BACKGROUND OF THE INVENTION

The subject matter disclosed herein relates to refrigerator appliances, and more particularly to increasing energy efficiency in such refrigerator appliances.

One common configuration of a refrigerator appliance is known as a bottom mount configuration. In a bottom mount configuration, the freezer compartment is located below the fresh food compartment.

In a traditional airflow system in such bottom mount refrigerators, air is drawn over an evaporator coil by an evaporator fan and thereby cooled. The evaporator coil and fan are located in the freezer compartment as part of an evaporator assembly. Note that the evaporator assembly is the part of the refrigeration system through which refrigerant passes to absorb and remove the heat in the compartments being cooled (e.g., freezer compartment and fresh food compartment).

The cooled air from the evaporator fan is blown into an evaporator fan cover assembly (e.g., 802 in FIG. 8). The evaporator fan cover assembly is substantially closed with the exception of a first opening configured to allow evaporator cooled air to be directed into the freezer compartment (e.g., 800 in FIG. 8), and a second opening configured to allow evaporator cooled air to be directed into a fresh food cooled air supply duct. The fresh food cooled air supply duct runs up the outside of the fresh food compartment to an opening at the top of the fresh food compartment in many designs and on the inside of the compartment in other designs.

Accordingly, a majority of the evaporator cooled air that is blown into the evaporator fan cover assembly is directed into the freezer compartment. However, some evaporator cooled air blown into the evaporator fan cover assembly is directed up into the fresh food cooled air supply duct to the opening at the top of the fresh food compartment. The evaporator cooled air enters the fresh food compartment through this opening.

Such a traditional evaporator fan cover assembly introduces a large amount of restriction and thus pressure drop into the airflow system, i.e., since the evaporator fan cover assembly is substantially closed and catches the high volume airflow directly from the evaporator fan before directing a majority of the airflow into the freezer compartment and a smaller portion of the airflow toward the fresh food compartment. However, this large amount of restriction and pressure drop causes the airflow system to work harder, thus reducing the efficiency of the refrigerator.

BRIEF DESCRIPTION OF THE INVENTION

As described herein, the exemplary embodiments of the present invention overcome one or more disadvantages known in the art.

One embodiment relates to a refrigeration system. The refrigeration system comprises a first cooling compartment having a first cooling cavity area and a second cooling compartment having a second cooling cavity area. The first cooling compartment is positioned below the second cooling compartment, and the first cooling cavity area is maintained at a lower temperature than the second cooling cavity area. The refrigeration system also comprises an evaporator assembly comprising an evaporator and a fan. The evaporator assembly is operatively positioned in the first cooling compartment and configured such that a cooled air stream generated by the fan is provided into the first cooling cavity area for circulation therein. The refrigeration system further comprises at least one air outlet formed between the first cooling cavity area and a duct coupled to the second cooling cavity area. The air outlet is configured to permit at least a portion of the cooled air stream received in the first cooling cavity area from the evaporator assembly to be provided to the second cooling cavity area through the air outlet and via the duct. The refrigeration system still further comprises at least one air return formed between the evaporator assembly and the second cooling cavity area. The air return is configured such that air from the second cooling cavity area flows into the evaporator assembly through the air return.

In another embodiment, a bottom mount refrigerator appliance comprises a freezer compartment having a freezer cavity area and a fresh food compartment having a fresh food cavity area. The appliance also comprises an evaporator assembly comprising an evaporator and a fan, the evaporator assembly operatively positioned in the freezer compartment and configured such that a cooled air stream generated by the fan is provided into the freezer cavity area for circulation therein. The appliance further comprises at least one air outlet formed between the freezer cavity area and a duct coupled to the fresh food cavity area, the air outlet configured to permit at least a portion of the cooled air stream received in the freezer cavity area from the evaporator assembly to be provided to the fresh food cavity area through the air outlet and via the duct. The appliance still further comprises at least one air return formed between the evaporator assembly and the fresh food cavity area, the air return configured such that air from the fresh food cavity area flows into the evaporator assembly through the air return.

Advantageously, a refrigeration system (e.g., a bottom mount refrigerator appliance) according to embodiments of the invention eliminates the evaporator fan cover assembly and the airflow restriction and pressure drop associated therewith, thus resulting in improved energy efficiency.

These and other embodiments of the invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more of the embodiments of the invention will be described below in the context of a refrigerator appliance such as a household refrigerator. However, it is to be understood that embodiments of the invention are not intended to be limited to use in household refrigerators. Rather, embodiments of the invention may be applied to and deployed in any other suitable refrigeration system environment in which it would be desirable to improve energy efficiency.

Figure 1:
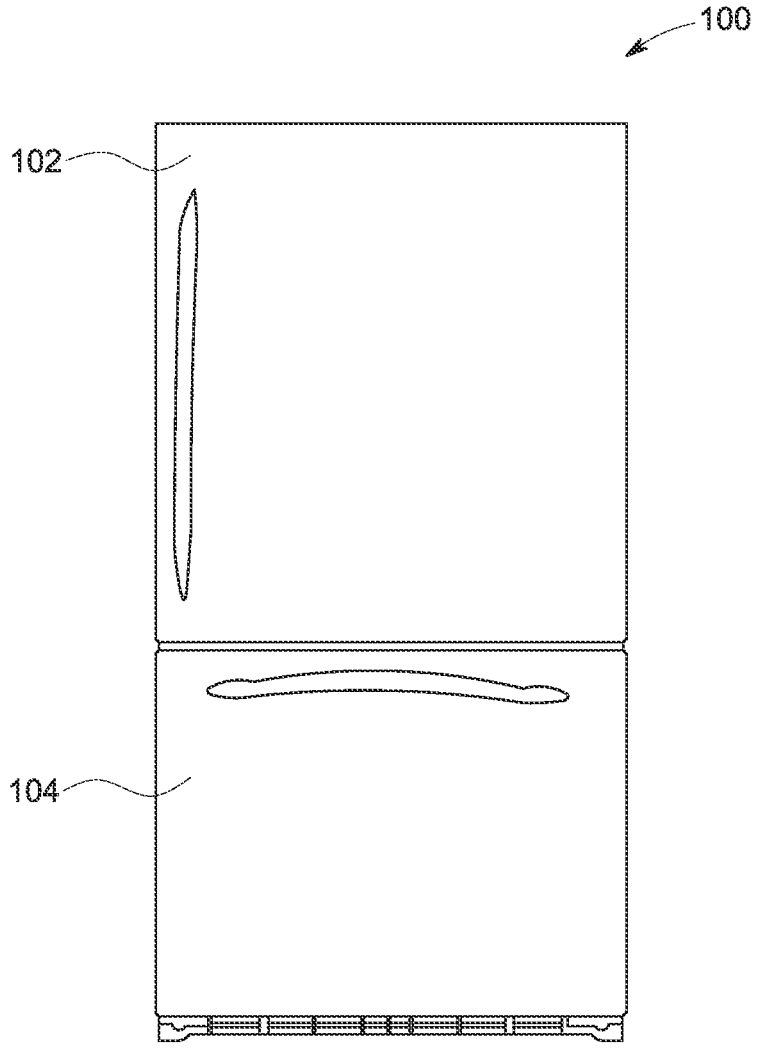
FIG. 1 is a diagram of a front view of a bottom mount refrigerator, in accordance with one embodiment of the invention.

FIG. 1 illustrates an exemplary refrigeration system in the form of refrigerator appliance 100 within which embodiments of the invention may be implemented. As is typical, a refrigerator has a fresh food compartment 102 and a freezer compartment 104. The fresh food compartment typically maintains foods and products stored therein at temperatures between about 32 and 40 degrees Fahrenheit in order to preserve the items therein, and the freezer compartment typically maintains foods and products at temperatures between about −4 and 32 degrees Fahrenheit in order to freeze the items therein.

More particularly, the refrigerator appliance 100 in FIG. 1 illustrates the fresh food compartment 102 and the freezer compartment 104 in a bottom mount configuration where the freezer compartment 104 is situated below the fresh food compartment 102.

It is to be appreciated that embodiments of the invention may be implemented in the refrigerator appliance 100. However, embodiments of the invention are not intended to be limited to implementation in a refrigerator such as the one depicted in FIG. 1. That is, embodiments of the invention may be implemented in other household refrigerator appliances, as well as non-household (e.g., commercial) refrigerator appliances. Furthermore, embodiments of the invention may be implemented in any appropriate refrigeration system.

As will be illustratively explained herein, embodiments of the invention provide a practical method of reducing energy use associated with a bottom mount airflow system. This is accomplished by eliminating the evaporator fan cover assembly, which, as explained above, directs air to the freezer and fresh food compartments and is a large source of restriction and pressure drop. With a less restrictive airflow system, the evaporator fan power level can be reduced while still providing sufficient airflow. The evaporator fan cover assembly is replaced with airflow openings effectively positioned between the freezer and fresh food compartments in the form of one or more air (supply) outlets and one or more air returns. The one or more air outlets formed between the freezer compartment and the fresh food compartment supply a portion of the cooled air circulating in the freezer compartment to the fresh food compartment. The one or more air returns then allow air from the fresh food compartment to return to the evaporator assembly in the freezer compartment.

Supplying the fresh food compartment with air from the freezer compartment allows for the elimination of the evaporator fan cover assembly and thus the pressure drop introduced into the system associated therewith. To deflect air up to the fresh food compartment, one or more embodiments of the invention utilize an air deflector (scoop) to direct freezer supply air to the fresh food supply ducting.

It is realized, in accordance with embodiments of the invention, that a pressure difference caused by the evaporator fan draws air into the fresh food compartment from the freezer compartment without the need for the traditional evaporator fan cover assembly. It is further realized that, for normal operation, about 5 to 8 cubic feet per minute (CFM) of airflow is needed for the fresh food compartment and about 35 to 45 CFM of airflow for the freezer compartment. Less fresh food compartment airflow is needed because air undergoes a larger change in temperature in the fresh food compartment and is able to absorb more heat. To further ensure sufficient fresh food compartment airflow, one or more embodiments of the invention utilize an air deflector or scoop to direct air into the fresh food compartment supply ducting by diverting a portion of the air stream that is generated by the evaporator fan as it begins to circulate in the freezer compartment. With the scoop present, the above-mentioned traditional evaporator fan cover assembly is not needed to direct air into the freezer compartment and the fresh food compartment.

In one or more embodiments, an evaporator fan safety screen is used, as will be described below, simply to prevent unintended contact with the fan blade by the consumer and/or items stored in the freezer compartment. Advantageously, this safety screen does not add measureable pressure drop.

The simplified airflow path according to embodiments of the invention also allows for a reduction in the size of the evaporator fan. It has been shown during testing that the typical 2.84 Watt evaporator fan can be replaced by a fan that draws about 1.51 watts while still providing similar airflow. A reduction of one watt from an evaporator fan saves about 3% in energy use on a product of this type. Fans running at a lower power produce less heat, which also decreases compressor run time.

Figure 2:
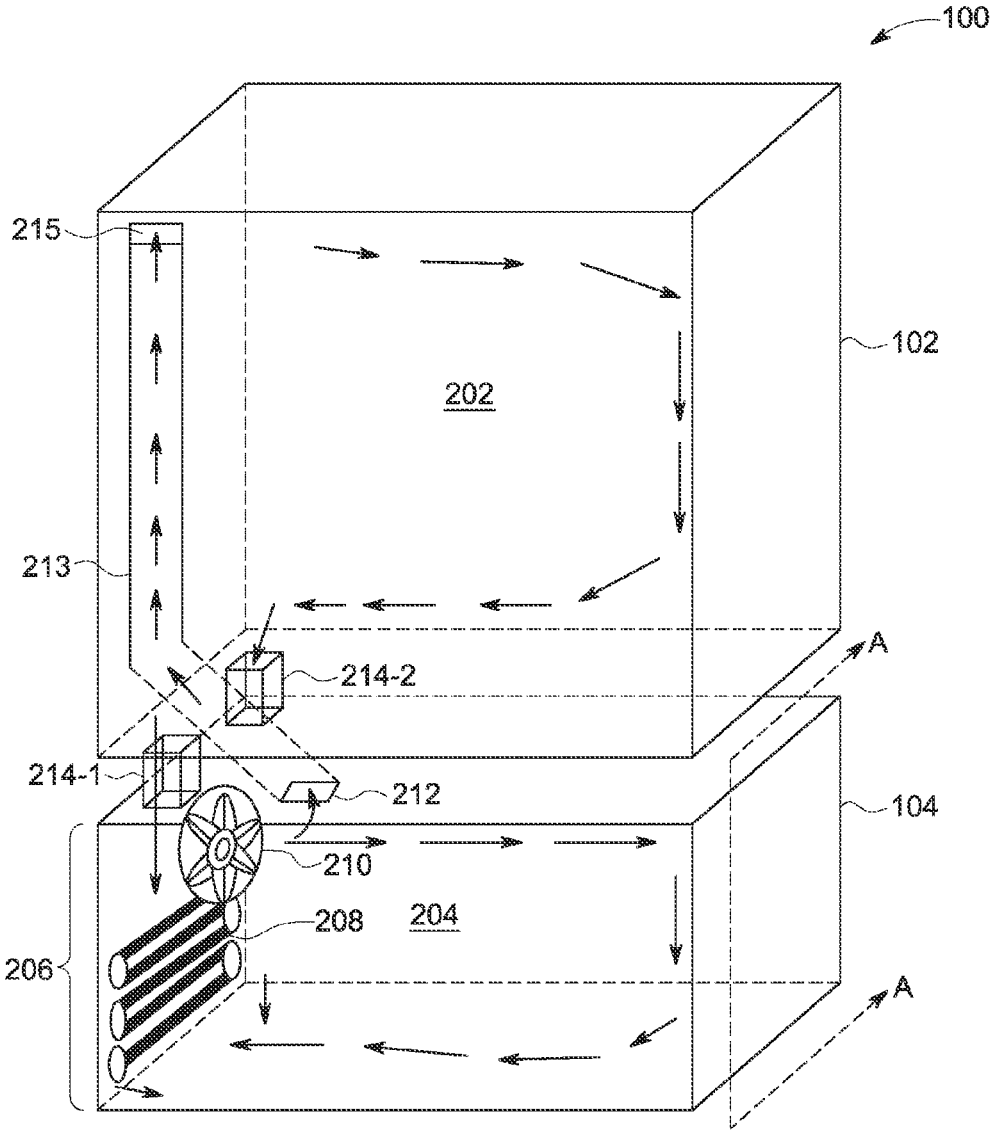
FIG. 2 is a schematic diagram of a perspective side view of an improved airflow system for a bottom mount refrigerator, in accordance with one embodiment of the invention.
Figure 3:
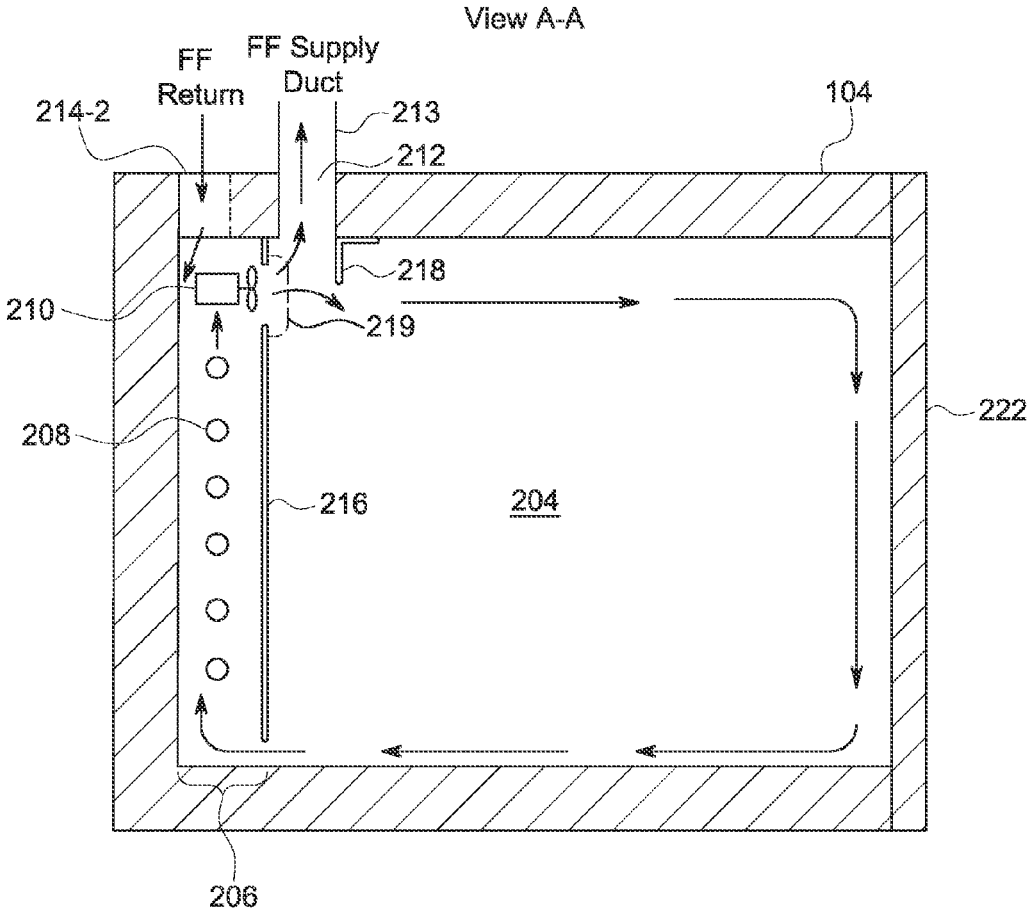
FIG. 3 is a schematic diagram of a side cutaway view of an improved airflow system for a bottom mount refrigerator, in accordance with one embodiment of the invention.

FIGS. 2 and 3 illustrate an improved airflow system for a bottom mount refrigerator such as, for example, refrigerator appliance 100 in FIG. 1. FIG. 2 shows a perspective side view of refrigerator appliance 100 with the front of the refrigerator to the right side of the figure and the rear of the refrigerator to the left side of the figure. FIG. 3 shows a side cutaway view of the freezer compartment 104 taken along line A-A of FIG. 2.

As shown, refrigerator appliance 100 comprises a fresh food compartment 102 and freezer component 104. The freezer component 104 comprises a freezer cavity area 204, while the fresh food compartment 102 comprises a fresh food cavity area 202. The cavity areas are the open areas in each cooling compartment in which cooled air circulates in order to freeze (freezer compartment) or keep fresh (fresh food compartment) food stored therein.

Operatively positioned in the rear of the freezer compartment 104 is an evaporator assembly 206. As shown, the evaporator assembly 206 comprises an evaporator coil (or simply, evaporator) 208 and a fan 210. The evaporator assembly 206 also comprises an evaporator cover 216 which is not expressly shown in FIG. 2 for the sake of clarity, but which is shown in the side cutaway view of FIG. 3.

The freezer compartment 104 also comprises an air outlet 212 formed between the freezer cavity area 204 and a fresh food cooled air supply duct 213 coupled to the fresh food cavity area 202. As mentioned above, the outlet supplies a portion of the cooled air stream from the freezer cavity area 204 to the fresh food cavity area 202 via the fresh food cooled air supply duct 213. It is to be understood that, in one embodiment, the duct 213 is exterior to the fresh food cavity area 202 and opens up into the fresh food cavity area 202 toward the top of the area through an opening 215. However, in another embodiment, the duct 213 may run up the inside surface of the liner wall of the fresh food cavity area 202. The duct may also be formed in the liner cavity itself.

The freezer compartment 104 also comprises a pair of air returns 214-1 and 214-2 formed between the evaporator assembly 206 and the fresh food cavity area 204. In alternative embodiments, less (e.g., one) or more (e.g., three or more) air returns may be employed in the airflow system.

The airflow path between the evaporator and freezer compartment is configured and the outlet(s) between the freezer compartment and the fresh food compartment and the returns from the freezer and fresh food compartments to the evaporator are sized to provide the desired proportional air flow to the fresh food compartment. Such sizing may be determined empirically for each particular design as is well known in the art.

In this embodiment, refrigeration efficiency is improved, particularly in high humidity environments, by positioning the air returns 214-1 and 214-2 to respective sides of the evaporator assembly 206, as shown in FIG. 2. Since much of the humidity that causes frost to form on evaporator coil 208 is carried in the airflow that returns from the fresh food cavity area 202, it is advantageous to position these returns above and at the respective sides of the evaporator coil 208 so frost tends to form at the sides while still allowing airflow through the center of the evaporator coil 208. Another reason for this configuration is to dehumidify the air and encourage the frost to form on the evaporator and not on the blade of fan 210 where it could freeze in place. An alternative air return method is to carry returning fresh food air below the evaporator 208 by running one or more ducts behind the liner of the freezer compartment 204 and into the bottom of the evaporator assembly 206.

The refrigerator appliance 100 also comprises an air deflector (scoop) 218 mounted proximate to the air outlet 212. The air deflector or scoop 218 directs air into the fresh food cooled air supply duct 213 by diverting a portion of the air stream that is generated by the evaporator fan 210 as it exits the evaporator assembly 206 and begins to circulate in the freezer cavity area 204.

The refrigerator appliance 100 also comprises an evaporator fan safety screen 219. The safety screen 219 prevents unintended contact with the fan blade by the consumer and/or items stored in the freezer cavity area 204. Note that the safety screen 219 is positioned at the airflow output of the evaporator fan 210 in approximately the location that the above-mentioned restrictive evaporator fan cover assembly would be located in a traditional airflow system. However, the safety screen 219 does not cause the restriction and pressure drop caused by the traditional evaporator fan cover assembly. Examples of safety screens are described below in the context of FIGS. 5 and 6.

The evaporator assembly 206 is operatively positioned in the freezer compartment 104 and configured such that a cooled air stream generated by fan 210 is provided into the freezer cavity area 204 and circulated therein (see airflow arrows circulating through area 204). Note that airflow to the left of the evaporator cover 216 shown in FIG. 3 is considered low side (or low pressure) airflow, while airflow to the right of the cover 216 is considered high side (or high pressure) airflow. Note also that the freezer compartment door is denoted in FIG. 3 with reference label 222.

The air outlet 212 and the air deflector 218 are configured to permit at least a portion of the cooled air stream generated by fan 210 of the evaporator assembly 206 and circulated in the freezer cavity area 204 to be diverted into the fresh food cavity area 202 via the fresh food cooled air supply duct 213. It is to be understood that while the air deflector 218 is advantageously used to direct airflow through the air outlet 212, in one embodiment, the deflector 218 can be removed such that air flows into the air outlet 212 without the aid of the deflector 218. That is, air from the freezer cavity area 204 flows into the supply duct 213 for the fresh food cavity area 202 through the air outlet 212 due to a pressure differential between the freezer cavity area 204 and the fresh food cavity area 202.

The air returns 214-1 and 214-2 are configured such that air circulating in the fresh food cavity area 202 flows into the evaporator assembly 206 through the air returns 214-1 and 214-2. Note also that airflow from the freezer cavity area 204 returns to the evaporator assembly 206 beneath the bottom edge of the evaporator cover 216. Alternatively, the cover could extend to the floor of the freezer compartment and one or more slots or openings could be provided proximate the floor to provide air passages for the air returning to the evaporator from the interior of the freezer compartment. The air returning from the freezer cavity area 204 and the air returning from the fresh food cavity area 202 mix and is drawn by the fan 210 across the evaporator coil 208 through which the refrigerant passes to absorb and remove the heat from the warmer returning air. The cooled air is then pushed out into the freezer cavity area 204 by the fan 210, and the cycle repeats. It should be noted that the air is drawn from the fresh food returns across the coil due to the low pressure caused by the fan. The air only flows through the fresh food returns when the fan is running. So there is no tendency for the fresh food air to flow into the freezer.

Figure 4:
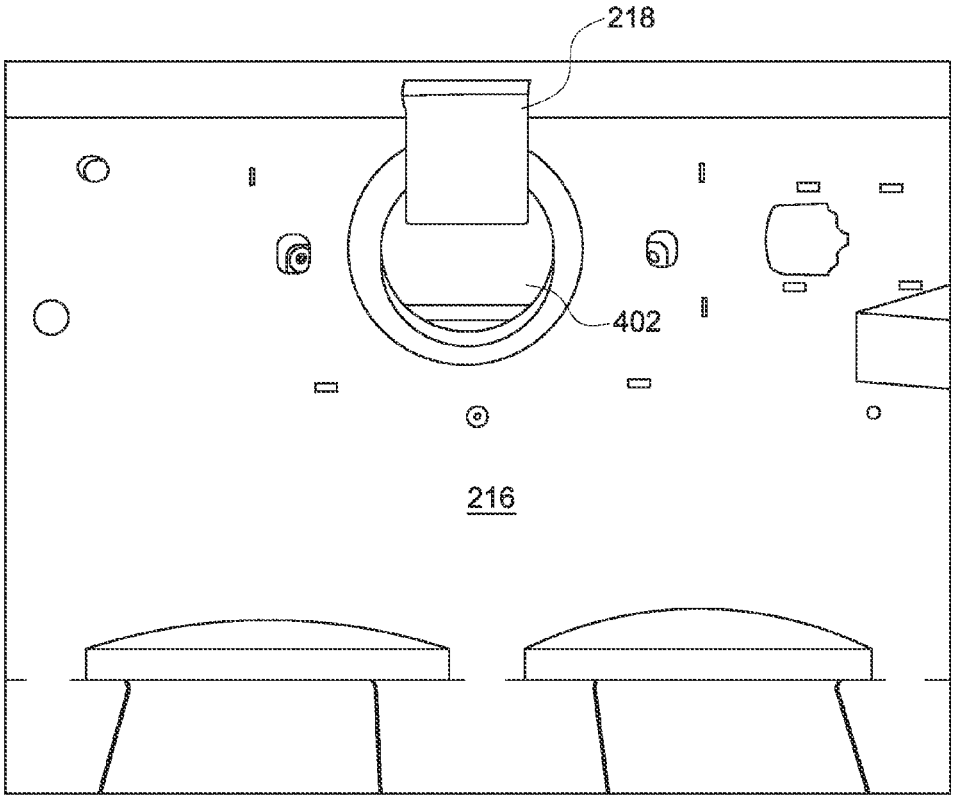
FIG. 4 is a front view of an evaporator assembly and air deflector for a bottom mount refrigerator, in accordance with one embodiment of the invention.

FIG. 4 is a diagram illustrating a front view of an evaporator assembly and air deflector for a bottom mount refrigerator, in accordance with one embodiment of the invention. More specifically, FIG. 4 shows the evaporator cover 216 and the air deflector (scoop) 218 described above. Note that reference label 402 in FIG. 4 denotes the opening through which the cooled airflow generated by the evaporator fan 210 enters the freezer cavity area 204 (the evaporator fan is not shown in FIG. 4). Note how the air deflector 218 is situated, partially in front of the opening 402, to deflect a portion of the airflow from the fan 210 into the fresh food supply duct 213. Also, the safety screen 219 (not shown in FIG. 4) covers the opening 402 to prevent injury to the consumer or damage to food items or the fan blade.

Figure 5:
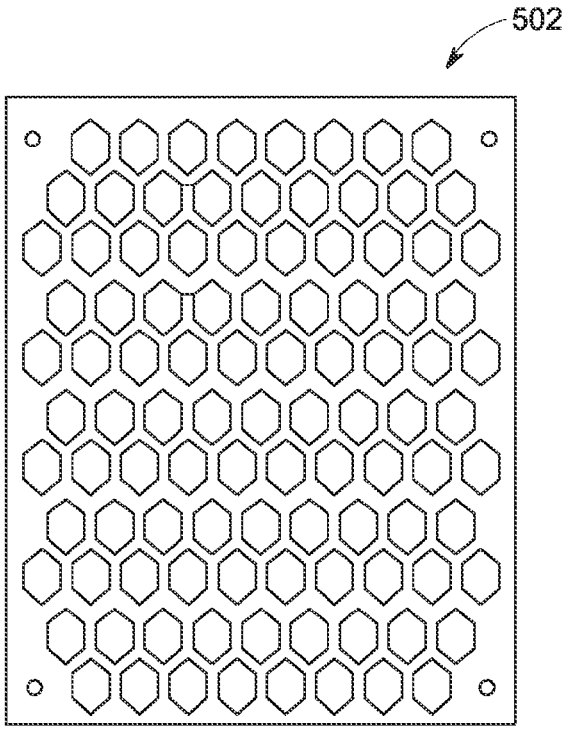
FIG. 5 is a front view of an evaporator fan safety screen for a bottom mount refrigerator, in accordance with one embodiment of the invention.
Figure 6:
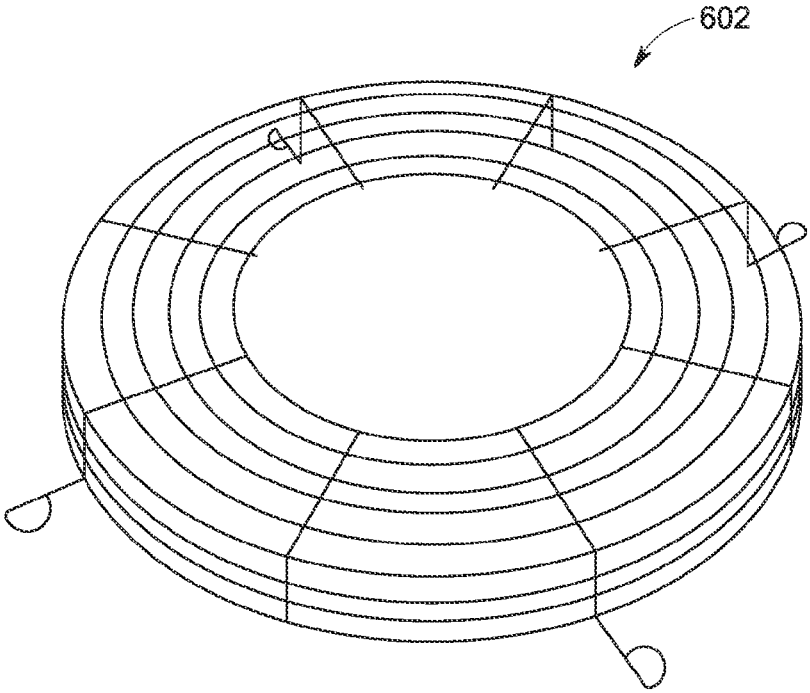
FIG. 6 is a front view of an evaporator fan safety screen for a bottom mount refrigerator, in accordance with another embodiment of the invention.

FIGS. 5 and 6 are diagrams of an evaporator fan safety screen for a bottom mount refrigerator, in accordance with embodiments of the invention. Safety screen 502 illustrated in FIG. 5 is one example of evaporator fan safety screen 219 (FIG. 3). Safety screen 602 illustrated in FIG. 6 is another example of evaporator fan safety screen 219. Other safety screen designs can be employed which serve as a fan guard without causing significant resistance and pressure drop in the airflow system.

Figure 7:
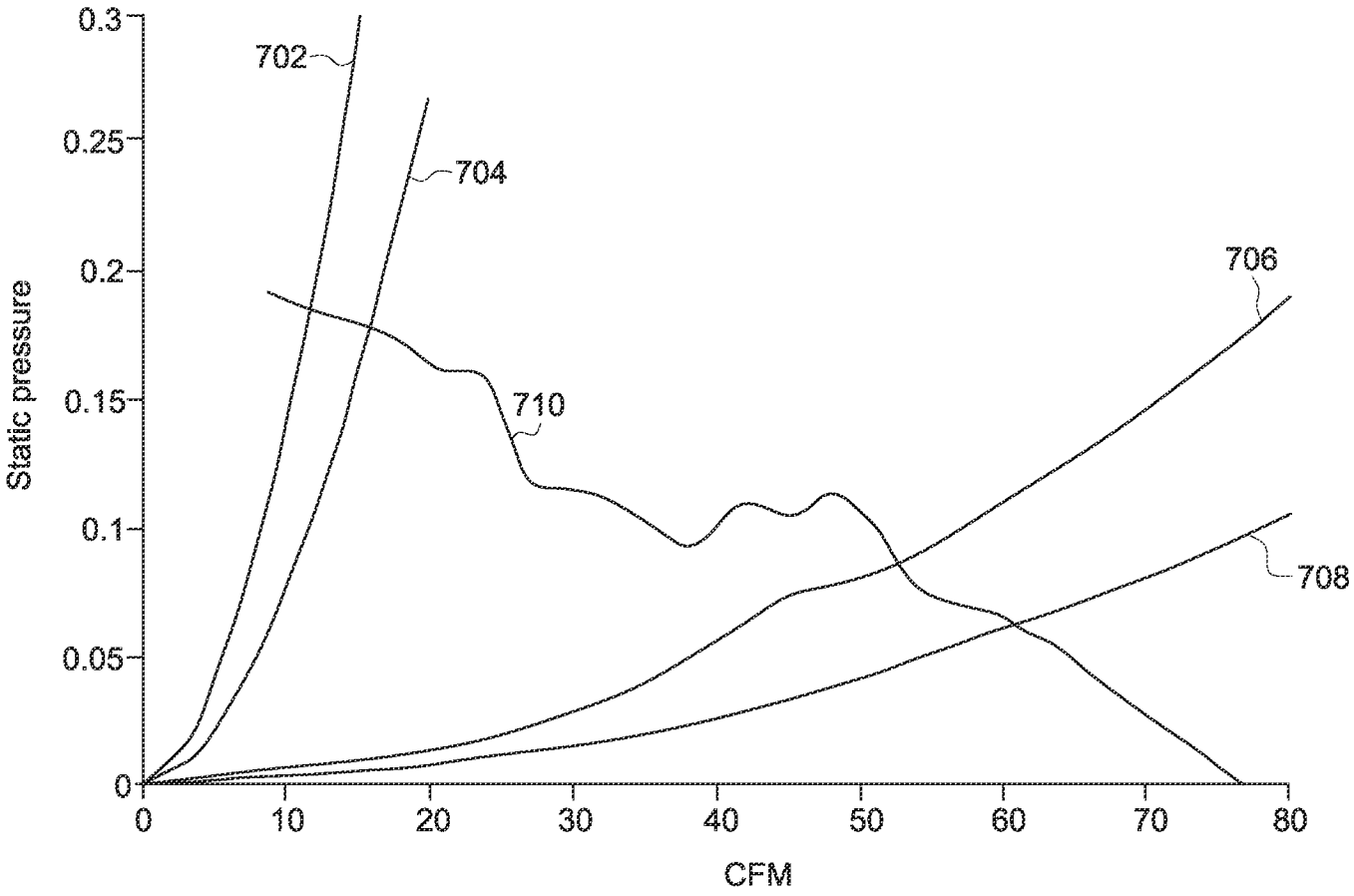
FIG. 7 is a graph illustrating performance improvement associated with an airflow system in accordance with one embodiment of the invention.
Figure 8:
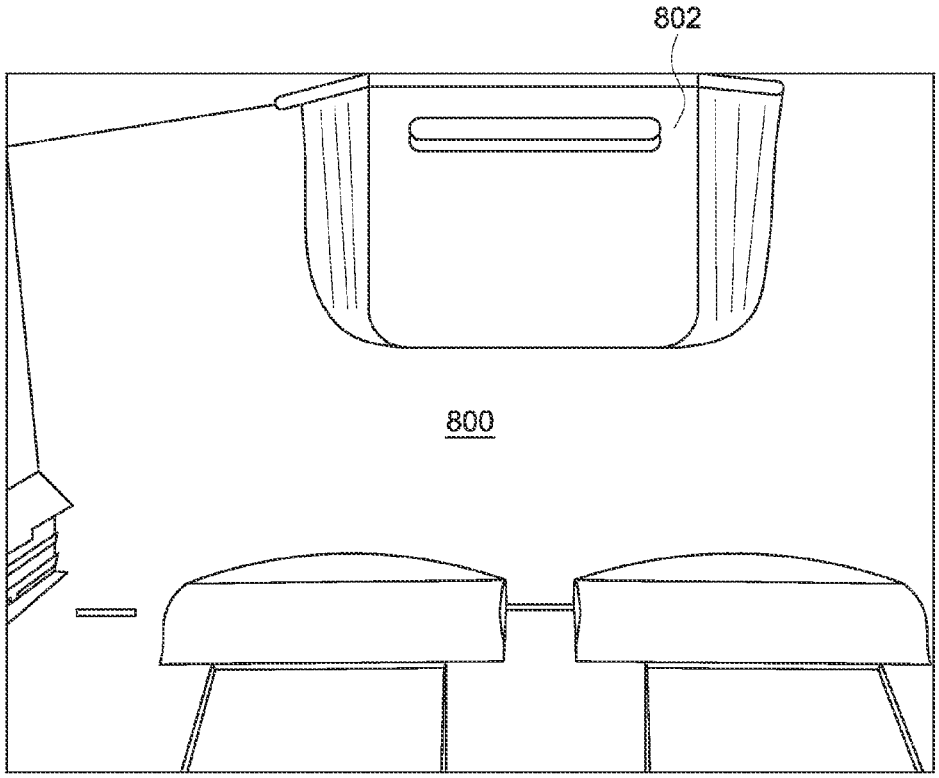
FIG. 8 PRIOR ART
FIG. 8 is a front view of an evaporator fan cover assembly.

FIG. 7 is a diagram illustrating performance improvement associated with an airflow system in accordance with one embodiment of the invention. In particular, the graph in FIG. 7 shows various baseline and modified (mod) curves representing the static pressure required to push a given airflow through a system, such as a bottom mount refrigerator. "Baseline" refers to a traditional bottom mount refrigerator configuration that uses an evaporator fan cover assembly as mentioned above. "Modified" (or "mod") refers to a bottom mount refrigerator configuration according to one or more of the embodiments of the invention. Thus, as shown, curve 702 depicts the baseline fresh food resistance, while curve 704 depicts the modified fresh food resistance. Curve 706 depicts the baseline freezer resistance, while curve 708 depicts the modified freezer resistance. Curve 710 depicts the baseline fan curve.

It is to be appreciated that temperature control for the embodiments herein described may be implemented in a conventional manner well known to those ordinarily skilled in the art. For example, the cooling system may be configured to respond to the temperature in the fresh food compartment. More particularly, a temperature sensor monitors the temperature in the fresh food compartment. When the temperature exceeds the reference turn-on temperature associated with the user selected set point temperature for the compartment, the compressor turns on. When the temperature drops below the reference turn-off temperature associated with the set point temperature, the compressor turns off.

It is to be further appreciated that one ordinarily skilled in the art will realize that well-known heat exchange and heat transfer principles may be applied to determine appropriate dimensions and materials of the various assemblies illustratively described herein, as well as flow rates of refrigerant that may be appropriate for various applications and operating conditions, given the inventive teachings provided herein.

It is also to be appreciated that the refrigeration systems described herein may have control circuitry including, but not limited to, a microprocessor (processor) that is programmed, for example, with suitable software or firmware, to implement one or more techniques as described herein. In other embodiments, an ASIC (Application Specific Integrated Circuit) or other arrangement could be employed. One of ordinary skill in the art will be familiar with refrigeration systems and given the teachings herein will be enabled to make and use one or more embodiments of the invention; for example, by programming a microprocessor with suitable software or firmware to cause the refrigeration system to perform illustrative steps described herein. Software includes but is not limited to firmware, resident software, microcode, etc. It is to be further understood that part or all of one or more features of the invention discussed herein may be distributed as an article of manufacture that itself comprises a tangible computer readable recordable storage medium having computer readable code means embodied thereon. The computer readable program code means is operable, in conjunction with a computer system or microprocessor, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer or processor to read instructions and data, such as magnetic variations on magnetic media or height variations on the surface of a compact disk. The medium can be distributed on multiple physical devices. As used herein, a tangible computer-readable recordable storage medium is intended to encompass a recordable medium, examples of which are set forth above, but is not intended to encompass a transmission medium or disembodied signal. A microprocessor may include and/or be coupled to a suitable memory.

Furthermore, it is also to be appreciated that embodiments of the invention may be implemented in electronic systems under control of one or more microprocessors and computer readable program code, as described above, or in electromechanical systems where operations and functions are under substantial control of mechanical control systems rather than electronic control systems.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A refrigeration system comprising:

a first cooling compartment having a first cooling cavity area;

a second cooling compartment having a second cooling cavity area, wherein the first cooling compartment is positioned below the second cooling compartment, and the first cooling cavity area is maintained at a lower temperature than the second cooling cavity area;

an evaporator assembly comprising an evaporator and a fan, the evaporator assembly operatively positioned in the first cooling compartment and configured such that a cooled air stream generated by the fan is provided into the first cooling cavity area for circulation therein;

at least one air outlet formed between the first cooling cavity area and a duct coupled to the second cooling cavity area, the air outlet configured to permit at least a portion of the cooled air stream received in the first cooling cavity area from the evaporator assembly to be provided directly from the first cooling cavity area to the second cooling cavity area through the air outlet and via the duct; and at least one air return formed between the evaporator assembly and the second cooling cavity area, the air return configured such that air from the second cooling cavity area flows into the evaporator assembly through the air return, wherein the first cooling compartment is a freezer compartment, the first cooling cavity area is a freezing cavity area, the second cooling compartment is a fresh food compartment, the second cooling cavity area is a fresh food cavity area, and the evaporator assembly is positioned in the freezing cavity area of the freezer compartment.

2. The refrigeration system of claim 1, further comprising an air deflector mounted entirely within the first cooling compartment proximate to the air outlet and configured to deflect at least a portion of the air stream received in the first cooling cavity toward the air outlet.

3. The refrigeration system of claim 1, further comprising at least another air return formed between the evaporator assembly and the second cooling cavity area, the other air return also configured such that air from the second cooling cavity area flows into the evaporator assembly.

4. The refrigeration system of claim 3, wherein the one air return is positioned above one side of the evaporator of the evaporator assembly and the other air return is positioned above another side of the evaporator of the evaporator assembly.

5. The refrigeration system of claim 1, wherein the evaporator assembly further comprises an evaporator assembly cover configured to permit at least a portion of the air stream generated by the fan circulating in the first cooling cavity area to re-enter the evaporator assembly from the first cooling cavity.

6. The refrigeration system of claim 1, wherein the duct coupled to the second cooling cavity area is configured to provide the portion of the cooled air stream to the second cooling cavity area via an opening at an upper portion of the second cooling cavity area.

7. The refrigeration system of claim 1, further comprising a second duct located between the at least one air return and the second cooling cavity area.

8. The refrigeration system of claim 1, wherein the evaporator assembly further comprises an evaporator fan safety screen.

9. A bottom mount refrigerator appliance comprising:

a freezer compartment having a freezer cavity area;

a fresh food compartment having a fresh food cavity area;

an evaporator assembly comprising an evaporator and a fan, the evaporator assembly operatively positioned in the freezing cavity area of the freezer compartment and configured such that a cooled air stream generated by the fan is provided into the freezer cavity area for circulation therein;

at least one air outlet formed between the freezer cavity area and a duct coupled to the fresh food cavity area, the air outlet configured to permit at least a portion of the cooled air stream received in the freezer cavity area from the evaporator assembly to be provided directly from the freezer cavity area to the fresh food cavity area through the air outlet and via the duct; and at least one air return formed between the evaporator assembly and the fresh food cavity area, the air return configured such that air from the fresh food cavity area flows into the evaporator assembly through the air return.

10. The bottom mount refrigerator appliance of claim 9, further comprising an air deflector mounted entirely within the freezer compartment proximate to the air outlet and configured to deflect at least a portion of the air stream received in the first cooling cavity toward the air outlet.

11. The bottom mount refrigerator appliance of claim 9, further comprising at least another air return formed between the evaporator assembly and the fresh food cavity area, the other air return also configured such that air from the fresh food cavity area flows into the evaporator assembly.

12. The bottom mount refrigerator appliance of claim 11, wherein the one air return is positioned above one side of the evaporator of the evaporator assembly and the other air return is positioned above another side of the evaporator of the evaporator assembly.

13. The bottom mount refrigerator appliance of claim 9, wherein the evaporator assembly further comprises an evaporator assembly cover configured to permit at least a portion of the air stream generated by the fan circulating in the freezer cavity area to re-enter the evaporator assembly from the freezer cavity area.

14. The bottom mount refrigerator appliance of claim 6, wherein the duct coupled to the fresh food cavity area is configured to provide the portion of the cooled air stream to the fresh food cavity area via an opening at an upper portion of the fresh food cavity area.

15. The bottom mount refrigerator appliance of claim 9, further comprising a second duct located between the at least one air return and the fresh food cavity area.

16. The bottom mount refrigerator appliance of claim 9, wherein the evaporator assembly further comprises an evaporator fan safety screen.

* * * * *